United States Patent [19]

Grosjean et al.

[11] 4,403,768

[45] Sep. 13, 1983

[54] BOTTOM OF METALLURGICAL CONTAINER AND PROCESS OF FORMING THE SAME

[75] Inventors: Jean-Claude Grosjean, Semecourt; Jean-Marie Landry, Maizieres-les-Metz, both of France

[73] Assignee: Institut de Recherches de la Siderurgie Francaise (IRSID), Saint-Germain-en-Laye, France

[21] Appl. No.: 325,844

[22] Filed: Nov. 30, 1981

[30] Foreign Application Priority Data

Dec. 2, 1980 [FR] France ..... 80 25615

[51] Int. Cl.[3] ..... C21C 5/44

[52] U.S. Cl. ..... 266/44; 266/270; 266/282; 266/283; 266/285

[58] Field of Search ..... 266/220, 280–285, 266/44

[56] References Cited

U.S. PATENT DOCUMENTS 4,053,147 10/1977 Moser et al. ..... 266/220
4,106,759 8/1978 Steinegger et al. ..... 266/220
4,238,121 12/1980 Harita et al. ..... 266/218
4,243,210 1/1981 Takashima ..... 266/220

FOREIGN PATENT DOCUMENTS 2455008 9/1979 France .

*Primary Examiner*—L. Dewayne Rutledge
*Assistant Examiner*—Christopher W. Brody
*Attorney, Agent, or Firm*—Michael J. Striker

[57] ABSTRACT

In a process for forming the bottom of a metallurgical container, especially the bottom of a converter for refining pig iron, of the type which comprises a metallic base, at least one layer of refractory material superimposed on the metallic base, a first layer of refractory bricks superimposed on the layer of refractory material, and a second layer of refractory bricks on said first layer, the steps of placing, spaced from each other, on said first layer a plurality of refractory elements permeable to gas and each enclosed in a metal casing open at the top, circumferentially surrounding the metal casing of each of the elements with bricks of a material which expands during rise of the temperature and thereafter completing the second layer with refractory bricks.

8 Claims, 3 Drawing Figures

BOTTOM OF METALLURGICAL CONTAINER AND PROCESS OF FORMING THE SAME

BACKGROUND OF THE INVENTION

The present invention relates to a process of forming the bottom of a metallurgical container, especially the bottom of a converter for refining hot metal.

Certain refining processes of a bath of molten metal, especially liquid hot metal, consist of combining with blowing oxygen from the top of the metallurgical container into the bath of molten metal, blowing a gas through the bottom of the container in order to obtain a mixing of the bath of molten metal during or after the blowing with oxygen. Such a process is especially described in the French Pat. No. 2,322,202. The gas, introduced through the bottom of the container, is usually an inert gas such as nitrogen or argon. The introduction of this neutral gas is carried out by means of refractory elements permeable to gas arranged in the bottom of the container.

In this case, the bottom of the metallurgical container is constituted in the following manner: It comprises, in succession, on a metal base, at least one layer of refractory material, a first layer of refractory bricks, a so-called layer of security, then a second layer of refractory bricks, a so-called wearing layer, in which are incorporated a plurality of refractory elements permeable to gas and spaced from each other.

The refractory elements permeable to gas are elements such as for instance described in the French patent application Nos. 79/10.445 of Apr. 26, 1979 and 80/0.2905 of Feb. 8, 1980 in the name of the present inventors. These elements are generally constituted by an assembly arranged and joined by refractory non-porous plates placed side-by-side without being joined by a fluid-tight material. The clamping and the cohesion of these plates is assured by hooping by means of a metallic envelope, whereby a closure plate completes the metallic envelope to assure the fluid-tightness of each element with respect to the exterior of the container and a conduit for feeding a gas under pressure is fixed in an airtight manner to each closure plate to be connected to a gas distribution channel for blowing gas under pressure through the gas-permeable element.

It has been ascertained, that in a bottom of a metallurgical container constructed as described above, the elements which are permeable to gas deteriorate rapidly and must be replaced.

SUMMARY OF THE INVENTION

It is an object of the present invention to provide a process of forming the bottom of a metallurgical container of a type mentioned above which, however, will prevent rapid deterioration of the refractory gas-permeable elements.

With these and other objects in view, which will become apparent as the description proceeds, the process according to the present invention of forming the bottom of a metallurgical container of the type which comprises a metallic base, at least a layer of refractory material superimposed on the metallic base, a first layer of refractory bricks superimposed on the layer of refractory material, and a second layer of refractory bricks superimposed on the first layer, the steps of placing spaced from each other on the first layer of refractory bricks a plurality of refractory elements permeable to gas and each enclosed in a metal casing having a bottom and a circumferential wall and being open at the top, surrounding the circumferential wall of the metal casing of each of the elements with bricks of material which expands during rise of the temperature, and thereafter finishing the construction of the second layer in the usual manner.

Preferably, the bricks which expand during rise of the temperature are formed from ceramically bonded magnesia impregnated with tar.

The inventors have studied the course of degradation of the refractory elements permeable to gas. It has been observed that this degradation results from an infiltration of liquid metal between the metallic casing and the refractory elements permeable to gas and that this infiltration was due to the swelling of the metallic elements during blowing of gas through the bottom thereof.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
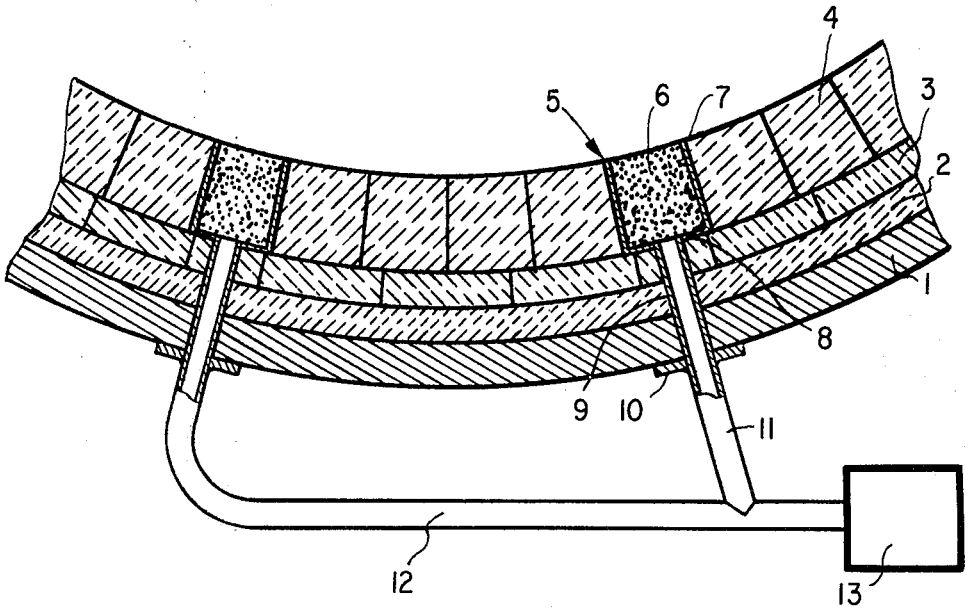
FIG. 1 (PRIOR ART)
FIG. 1 is a schematic vertical cross section of a substantially spherical bottom portion of a metallurgical container according to the prior art.

The bottom of a metallurgical container as illustrated in FIG. 1 comprises a metallic base 1, on which a layer of refractory material 2 is placed. A first layer 3 of refractory bricks, so-called "bricks of security", is placed on the layer of refractory material 2 and finally a second layer 4 of refractory bricks, so-called "bricks of use", is placed on the layer 3. Some of the bricks of the layer 4 are replaced by gas-permeable elements 5 of the type described above. These elements 5 are constituted by an assembly 6 of refractory plates laterally enclosed by a metallic casing 7 having a bottom plate 8 and being open at the top. Conduits 9 for feeding a gas under pressure extend through the metallic base 1 and the layers 2 and 3 through openings provided therein for this purpose, and these conduits pass also through openings in the bottom plates 8 of the metallic casing. The fluid-tightness between the conduits 9 and the layer 3 is assured either by a layer of fine magnesia powder or by a strand of asbestos to thus avoid the risk of passage of liquid metal around the conduits to the outside of the bottom of the metallurgical container. The conduits 9 are connected in a fluid-tight manner by means of base plates 10 to conduits 11 which in turn are connected to a feeder head 12 supplied from a source of gas under pressure schematically indicated at 13.

During blowing of gas through the conduits 9 the metal sheet constituting the envelope 7 expands and a space is created between the elements 6 and the envelope 7 into which liquid metal may eventually pass.

Considering these observations, the inventors have discovered that the swelling of the envelope 7 was due to the actual manner in which the layer 4 was constructed.

Up to now, the mounting of the gas-permeable elements 5 in the layer 4 has been effected in the following manner.

First, the layers 2 and 3 were formed on the metallic base 1 and the necessary opening for the passage of the conduits 9 were formed at locations provided for the final disposition of the gas-permeable refractory elements.

Figure 2:
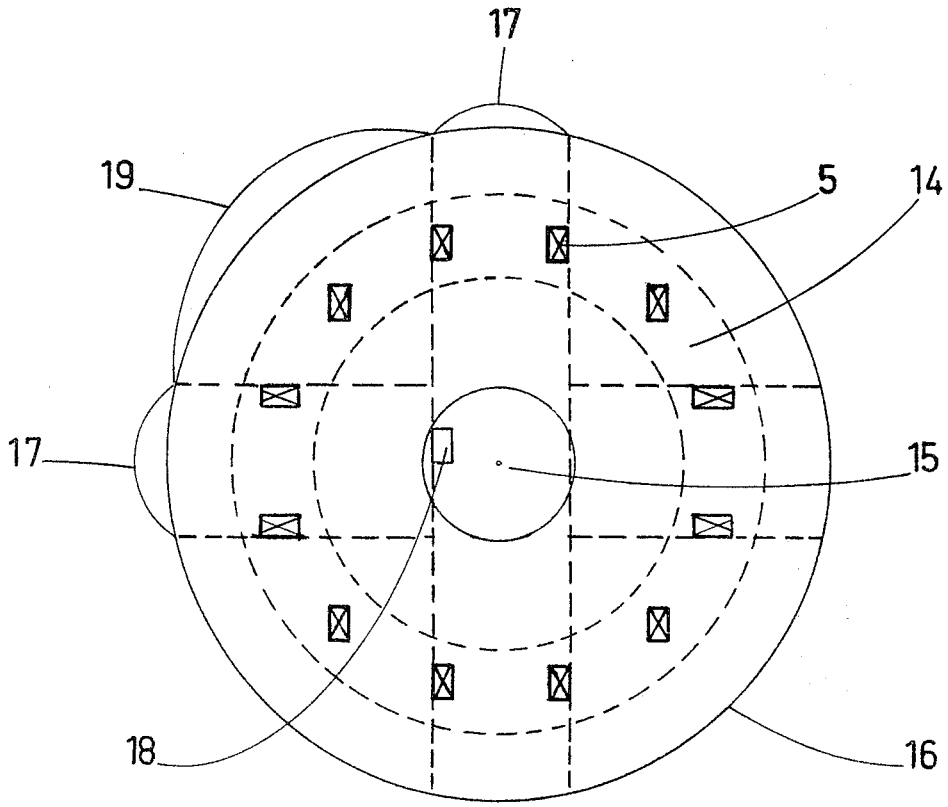
Fig. 2 PRIOR ART
FIG. 2 is a schematic top view of a bottom portion of a metallurgical container and illustrating a first step according to the prior art of forming the bottom of the metallurgical container.

It should also be mentioned that, generally, the refractory gas-permeable elements are distributed along an intermediate ring on the surface of the bottom of the container. As shown in FIG. 2, the gas-permeable elements 5 are distributed along a ring 14 located midway between the zone of impact 15 of a jet of oxygen to be blown from the top into the container and the peripheral wall 16 of the container.

Actually, in order to construct the layer 4 two central passages 17 (FIG. 2) perpendicular to each other and corresponding to two diameters normal to each other of the bottom of the container are traced on the layer 3. Subsequently thereto, a first row of refractory bricks is then formed along one half of these central passages by starting from the center, as shown at 18 in FIG. 2 and passing towards the exterior up to the peripheral wall 16, then a second row of bricks is laid in returning towards the center, etc., and one fills in this way each half of the passages with bricks by placing refractory elements 5 permeable to gas at each of the predetermined locations. In this way the four central half passages are finished. Subsequently thereto, the remaining four quarters of circles 19 are filled.

Even though the dimensions of the permeable elements are in principle identical with those of the refractory bricks, it happens often that it is necessary to place fluid-tight joints, formed for example by tamped magnesia, between the gas-permeable elements and the bricks adjacent thereto.

The inventors have ascertained that it is exactly at such locations, at which such fluid-tight joints are placed, that the degradation of the gas-permeable elements is produced, since these fluid-tight joints, which are deformable, do not prevent the sheet metal constituting the envelope of the element from expanding.

Considering these observations, a new manner of constructing the layer 4 has been invented which consists essentially of placing first the elements 5 permeable to gas at the predetermined locations and by surrounding each of the elements 5 by bricks formed of material which expands with rise of the temperature.

Figure 3:
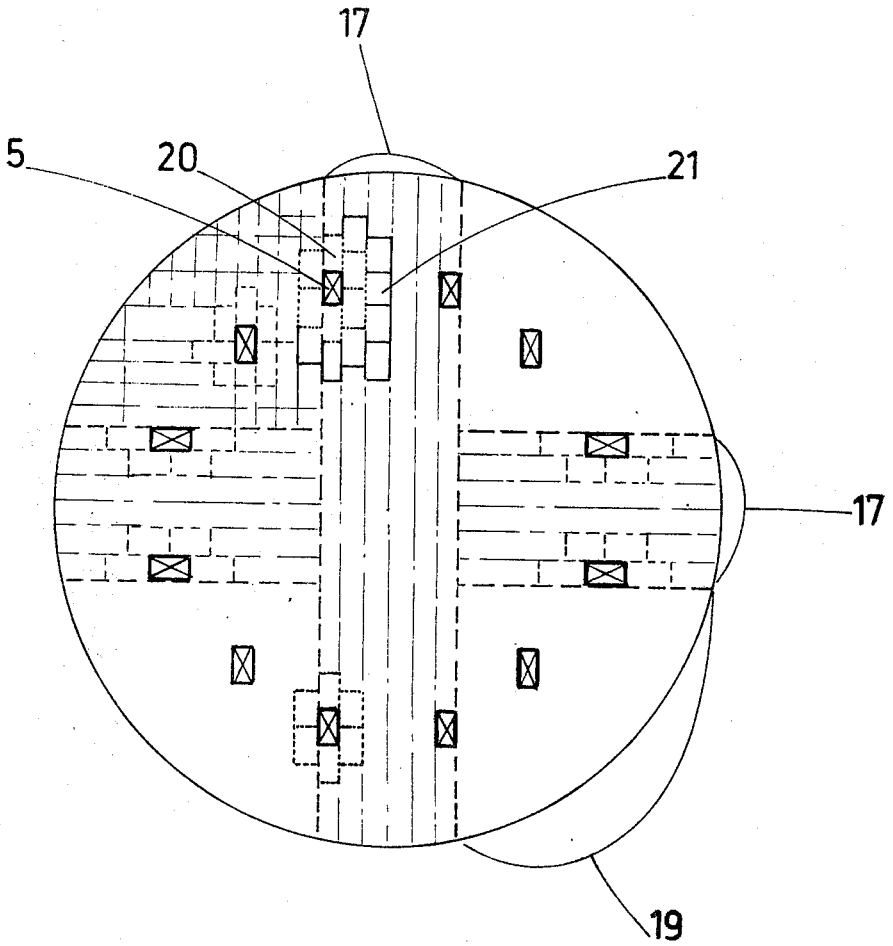
FIG. 3 is a top view similar to that shown in FIG. 2 and showing a step in the manufacture of the bottom portion of the metallurgical container according to the present invention.

This new manner of producing the layer 4 according to the present invention is illustrated in FIG. 3 which schematically illustrates a top view of the layer 4 during the construction thereof according to the present invention.

The layer 4 is formed according to the present invention in the following manner.

After having first traced on the layer 3 the two central passages 17 as described before, a plurality of gas-permeable refractory elements 5 are placed at predetermined locations. Subseqently thereto, each of the elements 5 is surrounded by bricks 20 formed from ceramically bonded magnesia impregnated with tar. Subsequently thereto, the construction of the layer 4 with refractory bricks 21 is finished in the usual manner.

During refining of the metallic bath in the container, the bricks 20 will expand during the heating and constitute some kind of vise tightly clamping the gas-permeable elements 5, thereby blocking an extension of the sheet metal constituting the envelope of each element 5. The bricks 20, in addition, have the advantage of resisting crushing and preventing erosion in the neighborhood of the elements 5.

If it is necessary to place at any moment during the construction of the layer 4 fluid-tight joints between two bricks, such fluid-tight joints are placed at locations as far as possible away from the gas-permeable elements 5.

An actual embodiment described above relates to the construction of a converter for refining of hot metal, of a capacity in the neighborhood of 300 tons, which includes twelve refractory elements permeable to gas. In this case, according to a preferred construction, on place eight of the elements in the passages 70 prior to placing four elements in the quarters of the circle 19.

It will be understood that each of the elements described above, or two or more together, may also find a useful application in other types of constructions differing from the types described above.

While the invention has been illustrated and described as embodied in processes for forming the bottoms of metallurgical containers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process of forming the bottom of a metallurgical container of the type which comprises a metallic base, at least a layer of refractory material superimposed on the metallic base, a first layer of refractory bricks superimposed on said layer of refractory material and a second layer of refractory bricks superimposed on said first layer, the steps of placing spaced from each other on said first layer of refractory bricks a plurality of refractory elements permeable to gas and each enclosed in a metallic casing having a bottom and a circumferential wall and being open at the top; surrounding the circumferential wall of the metallic casing of each of said elements with bricks of a material which expand during rise of the temperature so as to press during operation of the metallurgical container the peripheral wall of each metallic casing tightly against the respective gas permeable refractory element; and thereafter finishing the construction of said second layer by filling the remainder of the second layer with refractory bricks.

2. A process as defined in claim 1, including the step of providing for each of said elements a conduit extending fluid-tightly sealed through said metallic base, said layer of refractory material, said first layer of refractory bricks and the bottom of the respective metal casing for feeding a gas under pressure through the respective element.

3. A process as defined in claim 2, and including the step of connecting each of said conduits to a source of gas under pressure.

4. A bottom of a metallurgical container comprising a metal base; at least one layer of refractory material superimposed on said metal base; a first layer of refractory bricks superimposed on said layer of refractory material; and a second layer of refractory bricks superimposed on said first layer and comprising a plurality of spaced refractory elements permeable to gas and each enclosed in a metallic casing having a bottom wall, a peripheral wall and being open at the top, a plurality of bricks of a material which expands during rise of the temperature surrounding the peripheral wall of the metal casing of each element so as to press during operation of the metallurgical container the peripheral wall of each metallic casing tightly against the respective gas permeable refractory element, and refractory bricks forming the remainder of said second layer.

5. A bottom of a metallurgical container as defined in claim 4, and including a conduit for each of said refractory elements extending fluid-tightly sealed through said metal base, said layer of refractory material, said first layer of refractory bricks and the bottom wall of the respective casing.

6. A bottom of a metallurgical container as defined in claim 4, wherein said bricks which expand during rise of the temperature are formed from ceramically bonded magnesia.

7. A bottom of a metallurgical container as defined in claim 6, wherein said bricks of ceramically bonded magnesia are impregnated with tar.

8. A bottom of a metallurgical container as defined in claim 4, wherein said bottom of said metallurgical container is the bottom of a converter for refining pig iron by blowing oxygen from above onto a central portion of the converter, wherein said gas permeable elements serve to blow a stirring gas through said bottom, and wherein said gas permeable elements are arranged in a circle substantially midway between said central portion and the outer periphery of said converter.

* * * * *